US005713719A

United States Patent [19]

Fiore et al.

[11] Patent Number: 5,713,719

[45] Date of Patent: Feb. 3, 1998

[54] SELF FLUSHING CENTRIFUGAL PUMP

[75] Inventors: Raymond F. Fiore, Peoria; Kenneth D. Themanson, Kewanee, both of Ill.

[73] Assignee: Caterpillar Inc., Peoria, Ill.

[21] Appl. No.: 694,977

[22] Filed: Aug. 9, 1996

Related U.S. Application Data

[63] Continuation-in-part of Ser. No. 569,620, Dec. 8, 1995, abandoned.

[51] Int. Cl.[6] ..... F04D 1/00

[52] U.S. Cl. ..... 415/58.2; 415/111; 415/113; 415/230; 415/231

[58] Field of Search ..... 416/104, 106, 416/107, 111, 113, 230, 231, 54.1, 58.2, 58.3, 58.4, 168.2, 175, 177; 277/22, 81 R

[56] References Cited

U.S. PATENT DOCUMENTS

| | | | |
|---|---|---|---|
| 1,664,572 | 4/1928 | Poulsen . | |
| 1,867,290 | 7/1932 | Vitu . | |
| 1,867,652 | 7/1932 | Burks . | |
| 1,871,747 | 8/1932 | Schlachter . | |
| 2,028,783 | 1/1936 | Jacobsen . | |
| 2,361,521 | 10/1944 | Yates . | |
| 2,641,190 | 6/1953 | Johnson . | |
| 3,001,517 | 9/1961 | Baker et al. . | |
| 3,037,458 | 6/1962 | Olmstead et al. . | |
| 3,070,028 | 12/1962 | Loy et al. . | |
| 3,160,108 | 12/1964 | Sence . | |
| 3,541,607 | 11/1970 | Greene . | |
| 3,581,504 | 6/1971 | Andrus . | |
| 5,156,522 | 10/1992 | Tessier | 415/58.2 |
| 5,195,867 | 3/1993 | Stirling | 415/111 |

FOREIGN PATENT DOCUMENTS

| | | | |
|---|---|---|---|
| 890 901 | 10/1953 | Germany | 415/231 |

*Primary Examiner*—Edward K. Look
*Assistant Examiner*—Christopher Verdier
*Attorney, Agent, or Firm*—Alan J. Hickman

[57] ABSTRACT

A self flushing centrifugal pump has a fluid flushing passageway disposed in a housing of the pump which directs flushing fluid flow from a volute passageway in the housing of the pump near an outlet port of the pump to a chamber in the pump near a pump shaft seal and from the chamber to an inlet port of the pump via apertures in the impeller of the pump in response to rotation of the impeller.

8 Claims, 3 Drawing Sheets

SELF FLUSHING CENTRIFUGAL PUMP

CROSS-REFERENCE TO RELATED APPLICATIONS

This is a continuation-in-part of Ser. No. 08/569,620 dated Dec. 8, 1995, now abandoned.

TECHNICAL FIELD

This invention relates to a centrifugal pump and more particularly to a self flushing centrifugal pump that delivers seal flushing fluid from the high pressure outlet of the pump to the low pressure inlet by way of the cavity in which the seal is located.

BACKGROUND ART

Centrifugal pumps, particularly those suitable for use on internal combustion engines, circulate engine cooling fluid between the engine and a radiator in order to maintain the engine at a proper operating temperature. The heat exchanger, by way of convection, cools the fluid prior to its return to the engine.

Pumps of this type typically have an impeller rotatively connected to the housing by a shaft. The shaft is supported for rotation in the housing by a suitable bearing assembly. A seal is disposed about the shaft and connected to the housing in a cavity defined by a supporting side of the housing and a back side of the impeller. The seal maintains coolant fluid in the pump and from leaking therefrom.

The cavity defined by the space between the back side of the impeller and the supporting side of the housing is typically open to a volute passage in the pump. The cooling fluid flow induced by the impeller tends to flow radially outwardly in the volute towards the outlet. Thus, there is an insufficient or an insignificant flow of cooling fluid between the chamber and the volute passage. As a result, the cooling fluid in the chamber becomes somewhat stagnant and a collection point over time for residue and other debris commonly present in cooling systems. This results in premature wear and ultimately failure of the seal. A worn or failed seal means that coolant fluid and other contaminants can enter the bearing and cause bearing failure. This leakage also causes a depletion of system cooling fluid which ultimately results in engine overheating.

Seals used in cooling systems and the like, for example mechanical face type seals, typically have carbon and/or ceramic components which engage each other, separated by a thin fluid film, should resist coolant fluid from flowing thereby. These seals, although improved over the years, have a finite operating life. One factor that reduces the life of the seal is the temperature in which the seal operates. Due to the heat of friction generated between the faces, the fluid in the cavity becomes hotter than the cooling fluid being circulated by the impeller unless there is an adequate transfer of fluid between the volute passage and the cavity. Existing centrifugal pumps do not have adequate fluid transfer provisions. Thus, premature seal wear is prevalent.

The present invention is directed to overcome one or more of the above problems.

DISCLOSURE OF THE INVENTION

A self flushing centrifugal pump has a housing with an inlet port, an outlet port, a volute passageway connecting said inlet port to said outlet port, and a supporting side. The outlet port has an internal wall end defining the beginning of the outlet port. An impeller has a front side, a back side, and a pair of radially spaced apart apertures disposed in and opening at the front and back sides of the impeller. A shaft having a longitudinal axis rotatably connects the impeller to the housing. The impeller is disposed in the housing between the inlet and outlet ports and is rotatable to pump fluid from the inlet port to the outlet port through the volute passageway. The back side of the impeller and supporting side of the housing face each other and define a chamber therebetween. A seal is disposed in the chamber, connected to the housing, and in sealing engagement with the shaft. A chamber flushing passageway has a longitudinal central axis and is disposed in the housing a preselected depth from the supporting side of the housing. The chamber flushing passageway opens at the supporting side of the housing into the chamber at a location adjacent the seal and opens into the volute passageway at a predetermined location relative to the outlet port. The longitudinal central axis is at a preselected angle "a" relative to a radial line extending radially from the longitudinal shaft axis and tangent to the wall end. The preselected angle "a" is between 15 and 35 degrees. The chamber flushing passageway passes fluid flow from the volute passageway to said chamber and the radially spaced apart apertures pass fluid flow from the chamber to the inlet port in response to rotation of the impeller.

The location in the housing of the chamber flushing passageway relative to the outlet and the size of the passageway facilitates the directing of adequate fluid flow into the cavity. Adequate flushing of the cavity is therefore provided. Thus, seal life due to cooling, flushing and the like is increased.

The apertures being located in the hub of the impeller and open between the low pressure inlet and the higher pressure cavity further promotes fluid transfer in the chamber flushing passageway.

BEST MODE FOR CARRYING OUT THE INVENTION

Figure 1:
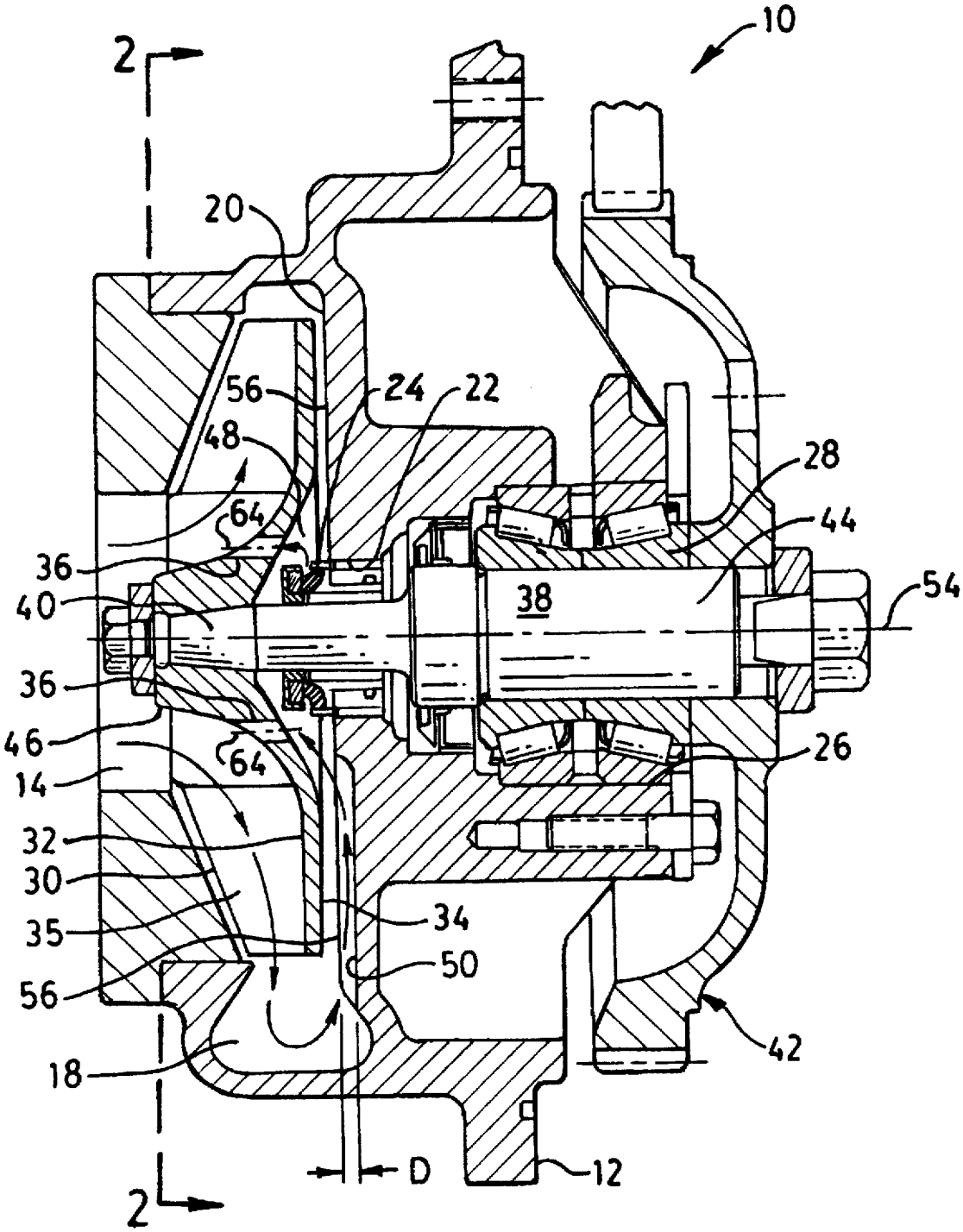
FIG. 1 is a diagrammatic cross sectional view of an embodiment of a self flushing centrifugal pump of the present invention.

With reference to the drawings, a self flushing centrifugal pump 10 is provided for passing cooling fluid between the block of an internal combustion engine and a radiator. The pump 10 has a housing 12 which is preferably formed from any suitable material. The housing 12 has an inlet port 14 and an outlet port 16. The inlet port 14 is connected to the radiator and the outlet port 16 is connected to the engine. The housing 12 has a volute passageway 18 connecting the inlet port 14 to the outlet port 16 and a supporting side 20. The supporting side 20 has a first counter bore 22 centrally disposed therein for receiving a seal 24, preferably a mechanical face type seal. The seal 24 is disposed in the first counterbore 22 and connected to the housing 12 by a press fit between the seal 24 and first counterbore 22. A second counterbore 26, concentric with said first counterbore 24, is disposed in the housing 12 and open to the first counterbore 22. An antifriction bearing 28, shown as a double tapered bearing assembly, is disposed in the second counterbore 26. The seal 24 is sealingly engaged with a shaft 38 and prevents cooling fluid from passing into the second counterbore 26.

An impeller 30 having a front side 32, a back side 34, and a pair of radially spaced apart apertures 36 disposed in and opening at the front 32 and back 34 sides is rotatively disposed in the housing 12. The front side 32 faces the inlet port 14 and the back side 34 faces the supporting side 20. The impeller 30 has a plurality of blades 35 connected to the front side 32. The blades 35 urge the passing of fluid flow from the inlet port 14 to the outlet port 16 during rotation of the impeller 30 in a conventional manner.

The shaft 38, which is rotatively supported in the housing 12 by antifriction bearings 28, rotatively connects the impeller 30 to the housing 12. The impeller 30 is secured to the shaft 38 at a first end portion 40 of the shaft 38 and a drive means 42 is secured to the second end portion 44 of the shaft 38. The impeller 30 has a hub 46 which is secured to the shaft first end portion 40 by mating tapers between the shaft 38 and a bore in the hub 46, and a threaded fastener, all of conventional design. The drive means 42, shown as a driven gear, but not limited thereto, is connected to the second end portion 44 by a threaded fastener of any suitable type well known in the art. The drive means 42 is preferably engine driven however other drive configurations are within the scope of this invention.

The impeller 30 is disposed in the housing 12 between the inlet 14 and outlet 16 ports and rotatable to pump fluid from the inlet port 14 to the outlet port 16 by way of the volute passage 18. The back side 34 of the impeller 30 and the supporting side 20 of the housing 12 are in close proximity to each other except in the area of the seal 24. A chamber 48 is defined between the back side 34 of the impeller 30 and supporting side 20 of the housing at a location adjacent the seal 24. Specifically, the chamber 48 is defined by the conical shape of the back side 34 of the impeller 30 and the supporting side 20 of the housing 12 at the location of the seal 24.

A chamber flushing passageway 50, disposed in the housing 12, connects the chamber 48 to the volute passageway 18 at a predetermined location relative to the outlet port 16. The chamber flushing passageway 50 passes fluid flow from the volute passageway 18 to the chamber 48. The radially spaced apart apertures 36 pass fluid flow from the chamber 48 to the inlet port 14 in response to rotation of the impeller 30.

Figure 2:
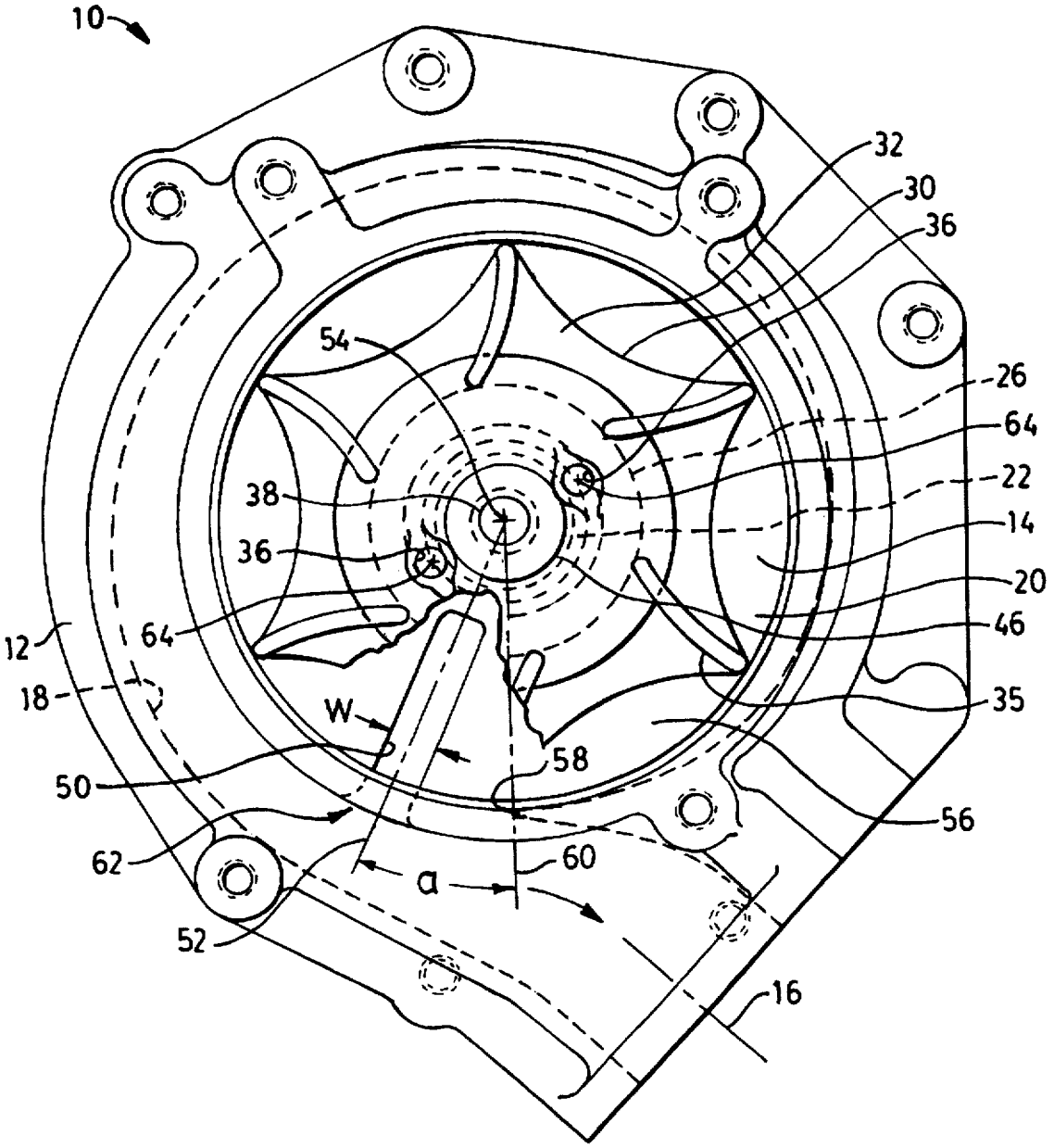
FIG. 2 is a diagrammatic view of the self flushing centrifugal pump of FIG. 1 with portions of the impeller broken away to show the flushing flow path in greater detail.
Figure 3:
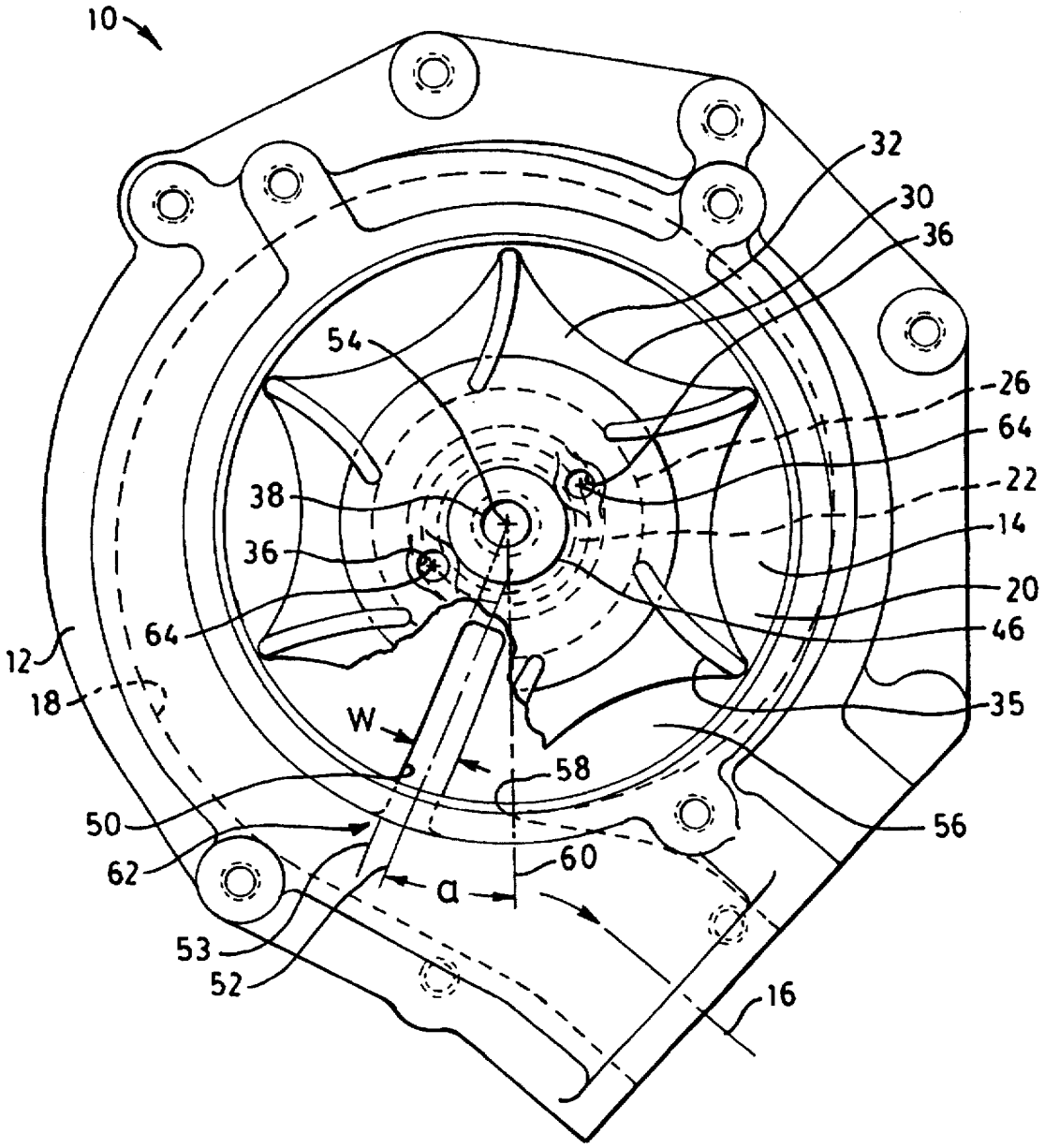
FIG. 3 is a diagrammatic view of another embodiment of the self flushing centrifugal pump with portions of the impeller broken away to show the flushing flow path in greater detail.

The chamber flushing passageway 50 has a longitudinal central axis 52. As shown in FIG. 2, the longitudinal central axis 52 is radially oriented relative to a longitudinal axis 54 of the shaft 38. As shown in FIG. 3, the longitudinal central axis 52 is spaced from and parallel to a radial line 53 passing through the longitudinal shaft axis 54. The chamber flushing passageway 50 is disposed in the supporting side 20 of the housing 12 a preselected depth "D" from a surface 56 of the supporting side 20. The chamber flushing passageway 50 is preferably open at the surface 56 of the supporting side 20 and channels cooling fluid flow to the chamber 48. The chamber flushing passageway 50 has a predetermined width "W" which is between 2 and 10 times the depth "D" of the chamber flushing passageway 50 measured from the surface 56 of the supporting side 20 of the housing 12. In one embodiment of the self flushing centrifugal pump, the chamber flushing passageway has a depth of 3 mm and a width of 17 mm. The cross sectional area defined by the depth "D" and width "W" is determined as a function of the rate of fluid flow required to adequately flush the chamber 48.

The chamber flushing passageway 50 preferably has a substantially "U" shaped cross sectional configuration taken transversely relative to the longitudinal central axis 52 of the chamber flushing passageway 50. It is to be noted that other transverse cross sectional shapes such as semi-circular, channel and the like are considered equivalents and within the scope of this invention.

An internal wall end 58 defines the location of the beginning of the outlet port 16 in the direction of flow of the exiting fluid. The longitudinal central axis 52 of the chamber flushing passageway 50 is oriented at a preselected radial angle "a" relative to a radial line 60 extending from the longitudinal shaft axis 54 and tangent to said internal wall end 58. The preselected radial angle is in the range of between 15 and 35 degrees. In the self flushing pump shown, the angle is nominally 25 degrees. The location of the chamber flushing passageway 50 relative to the outlet port 16 is instrumental in establishing the amount of flushing fluid flow provided for a given transverse cross sectional area of the chamber flushing passageway 50. The pressure of fluid flow is highest near the outlet port 16. It is desirable that the opening 62 of the chamber flushing passageway 50 into the volute passageway 18 is in the high pressure region of the volute passageway 18 and in close proximity to the outlet port 16.

Each aperture 36 of the pair of radially spaced apart apertures opens into the chamber 48 at a location adjacent the seal 24 and into the inlet port 14. The apertures 36 are preferably cylindrical and have a central axes 64. The central axis 64 of the apertures 36 are substantially parallel to each other and to the longitudinal axis 54 of the shaft 38.

The radially spaced apart apertures 36 are substantially diametrically opposite (180 degrees apart) relative to the longitudinal shaft axis 54 disposed in the hub 46. The apertures are substantially equally spaced from the longitudinal shaft axis 54 a preselected distance so that the openings remain in the inlet port 14 and in the chamber 48. The cross sectional area of the apertures 36, taken in a direction transverse the central axis 64, is of a magnitude sufficient to pass an adequate amount of flushing fluid flow from the chamber 48 to the inlet port 14 during normal operating conditions of the self flushing centrifugal pump 10.

The cross sectional area of the chamber flushing passageway 50, the location of the opening 62 in the volute passageway 18, and the cross sectional area of the apertures 36 are selected based on parameters, such as, the normal operating pressure of the pump 10 and the rate of fluid flow required to adequately flush the chamber 48. The amount of fluid flow required to adequately flush the chamber is determined by calculation or empirically.

INDUSTRIAL APPLICABILITY

With reference to the drawings, and in operation, the self flushing centrifugal pump 10 draws cooled fluid from the radiator and passes it to the engine. The cooled fluid from the radiator enters the inlet port 14 of the pump 10 and is urged by the rotating impeller 30 and the blades 35 thereof through the volute passageway 18, through the outlet port 16 and into the engine.

A portion of the cooled fluid being pumped by the impeller 30 is passed by the chamber flushing passageway 50 from the higher pressure location in the volute passageway 18 near the outlet port 16 to the chamber 48 and by the pair of apertures 36 from chamber 48 to the lower pressure inlet port 14. The cooled fluid circulated through the chamber 48 flushes and cools the seal 24. This results in a prolonged seal 24 life. As indicated above, cleansing of the seal 24 reduces the potential for undesirable particles to cause seal wear and premature failure during shaft 38 rotation. Also, by reducing the operating temperature of the seal 24, the life of the material of the seal 24 is extended. Having provided an adequate amount but not an excessive amount of flushing fluid flow, the efficiency of operation pump 10 is maximized.

Other aspects, objects and advantages of the present invention can be obtained from a study of the drawings, the disclosure and the appended claims.

We claim:

1. A self flushing centrifugal pump, comprising:

a housing having an inlet port, an outlet port, a volute passageway connecting said inlet port to said outlet port, and a supporting side, said outlet port having an internal wall end defining the beginning of the outlet port;

an impeller having a front side, a back side, and a pair of radially spaced apart apertures disposed in and opening at the front and back sides of the impeller, a shaft having a longitudinal axis and rotatably connecting the impeller to the housing, said impeller being disposed in the housing between the inlet and outlet ports and rotatable to pump fluid from the inlet port to the outlet port through the volute passageway, said back side of the impeller and supporting side of the housing facing each other and defining a chamber therebetween;

a seal disposed in the chamber, connected to the housing, and being in sealing engagement with the shaft;

a chamber flushing passageway having a longitudinal central axis and being disposed in the housing a preselected depth from the supporting side of the housing, said chamber flushing passageway opening at the supporting side of said housing into the chamber at a location adjacent the seal and opening into the volute passageway at a predetermined location relative to the outlet port, said longitudinal central axis being at a preselected angle "a" relative to a radial line extending from the longitudinal shaft axis and tangent to said wall end, said preselected angle "a" being between 15 and 35 degrees, said chamber flushing passageway passing fluid flow from the volute passageway to said chamber, and said radially spaced apart apertures passing fluid from the chamber to the inlet port in response to rotation of said impeller.

2. A self flushing centrifugal pump, as set forth in claim 1, wherein said chamber flushing passageway has a predetermined width, said width being between 2 and 10 times the depth of the chamber flushing passageway measured from the supporting side of the housing.

3. A self flushing centrifugal pump, as set forth in claim 2, wherein said chamber flushing passageway has a substantially "U" shaped cross sectional configuration taken in a transverse direction relative to the longitudinal central axis of the chamber flushing passageway.

4. A self flushing centrifugal pump, as set forth in claim 1, wherein said a pair of radially spaced apart apertures open into said chamber at a location adjacent the seal and opens into the inlet port.

5. A self flushing centrifugal pump, as set forth in claim 4, wherein said impeller has a hub and said spaced apart apertures are located substantially 180 degrees apart in the hub about the longitudinal shaft axis.

6. A self flushing centrifugal pump, as set forth in claim 5, wherein the spaced apart apertures each have a central axis, said central axis of the apertures being substantially parallel to the longitudinal axis of the shaft.

7. A self flushing centrifugal pump, as set forth in claim 1, wherein the longitudinal central axis of the chamber flushing passageway extends substantially radially outwardly relative to the longitudinal shaft axis.

8. A self flushing centrifugal pump, as set forth in claim 1, wherein said longitudinal central axis of the chamber flushing passageway extends parallel to a radial line passing through the longitudinal shaft axis.

* * * * *